US006058684A

United States Patent [19]

Suokas

[11] Patent Number: 6,058,684

[45] **Date of Patent: *May 9, 2000**

[54] APPARATUS FOR PACKAGING PAPER GOODS FORMING A STACK

[75] Inventor: Jouni Suokas, Tammela, Finland

[73] Assignee: Jomet Oy, Forssa, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,601

[22] PCT Filed: Jan. 4, 1996

[86] PCT No.: PCT/FI96/00010

§ 371 Date: Aug. 29, 1997

§ 102(e) Date: Aug. 29, 1997

[87] PCT Pub. No.: WO96/20869

PCT Pub. Date: Jul. 11, 1996

[30] Foreign Application Priority Data

Jan. 4, 1995 [FI] Finland ..... 950040

[51] Int. Cl.[7] ..... B65B 1/24

[52] U.S. Cl. ..... 53/529; 53/531; 53/535; 53/536; 53/540

[58] Field of Search ..... 53/447, 529, 540, 53/531, 535, 536, 381.1, 382.1; 493/52, 162

[56] References Cited

U.S. PATENT DOCUMENTS

| | | | |
|---|---|---|---|
| 3,562,775 | 2/1971 | Mullins | 53/26 |
| 4,614,511 | 9/1986 | Verhoef | 493/125 |
| 4,879,862 | 11/1989 | Nolte et al. | 53/438 |

FOREIGN PATENT DOCUMENTS

| | | |
|---|---|---|
| 0 245 226 A1 | 11/1987 | European Pat. Off. . |
| 0 424 718 A1 | 5/1991 | European Pat. Off. . |
| 83189 | 9/1991 | Finland . |
| 25 41 488 | 3/1976 | Germany . |
| 92 08 784 | of 1992 | Germany . |
| 632 202 | 9/1982 | Switzerland . |
| WO 88/02333 | 4/1988 | WIPO . |
| WO 95/20523 | 8/1995 | WIPO . |

*Primary Examiner*—Eugene L. Kim
*Attorney, Agent, or Firm*—Pollock, Vande Sande & Amernick

[57] ABSTRACT

The present invention provides a method and apparatus for packaging goods from a continuous stack. A conveyor is arranged on a base to move the continuous stack in a conveying direction. A separator means separates a stack portion of a predetermined size from the continuous stack. The stack portion is pushed aside from the conveying direction to a position within reach of a gripper. The gripper is used to transfer the stack along a second direction to at least one packaging position in a box or on a packaging blank. The gripper comprises at least two jaws which compress and hold the stack during the transfer. The gripper is arranged parallel to the base so that the base supports the stack portion from below during the transfer. In the method of the present invention, the stack portion is moved onto a cover part of a packaging blank and the packaging blank is folded around the stack portion to form a box.

13 Claims, 3 Drawing Sheets

APPARATUS FOR PACKAGING PAPER GOODS FORMING A STACK

FIELD OF THE INVENTION

The invention relates to an apparatus for packaging article goods forming a stack. Article goods is understood to mean goods consisting of single items of thin planar configuration, generally paper goods. The paper goods can be for example envelopes. In the following description and appended drawings, the invention will be presented as part of the production process of envelopes.

BACKGROUND OF THE INVENTION

For packaging paper goods forming a stack into boxes in batches of a certain size, apparatuses are used, in which the goods to be packaged are transferred by a conveyor as a continuous stack from the manufacturing process into a separation zone to be further divided into stack portions which will be moved into packaging boxes for the respective goods. Such an apparatus is known from Finnish Patent No. 87438 and also from U.S. Pat. No. 3,562,775. The principle in the solution according to the Finnish patent is the fact that the stack portion to be packaged is pushed directly from the separation zone into a packaging box with at least one open wall.

The stack portion is pushed into the packaging box by a transfer device comprising a rail placed transversely to the direction of travel of the goods stacks after the separation zone, and a movable pusher supported to the rail. The pusher is arranged to move in a perpendicular direction across the travel path of the stack, and its one end extends in the direction of the stack to a point where a stack portion to be packaged has been separated by separator elements included in the apparatus. By means of the pusher, the stack portion is pushed into a box situated at the same height and having an open wall on the side of the stack portion. The empty box is placed into the filling station manually or by machine. The most problematic disadvantage of this solution is that when the stack portion is pushed into the open box, the pusher cannot penetrate into the box but only to the edges of its open wall. Consequently, the solution performs poorly in a case when two or more stack portions are to be placed into the box, one after the other. To pack the paper goods in a sufficiently dense state into the packaging box, it is pressed by moving backwards a stack support supporting the stack in front of the same. Further, guides placed partly inside the box must be used for guiding the dense stack.

SUMMARY OF THE INVENTION

The above-mentioned disadvantages related to the known solutions of the prior art can be eliminated and thus the state of the art can be improved by using an apparatus according to the present invention.

In the solution according to the invention, the stack of goods to be packaged can be placed into a packaging box while being pressed by a gripper, wherein the jaws have simultaneously a guiding function. It is possible to adjust the point of delivery of the stack of goods in the box in the travel direction of the stack, before final placing of the stack portion in the package box. An important advantage of the present invention is the fact that the apparatus can be used for packaging each item irrespective of the number of stack portions in the package box or their order of packaging. These features make it possible to use the same apparatus for handling larger varieties of paper goods to be packaged, such as envelopes, and of package boxes, as will be disclosed below. The fact that the stack of goods to be packaged is placed into the box by a gripper moving parallelly to the base supporting the stack portion from below, contributes to the reliability of the apparatus, because a collision of the stack to be transferred with the edges of the box can be prevented, and no separate guides are necessary.

BRIEF DESCRIPTION OF THE DRAWINGS

In the following description, the invention will be described in detail with reference to the appended drawings, in which.

DETAILED DESCRIPTION OF THE INVENTION

The apparatus shown in the figures comprises a conveyor 1 which can be for example a belt conveyor running on a table plane A. The conveyor is supplied with paper goods, such as envelopes, as a continuous stack P in a way that single items of the paper goods form a stack lying against the conveyor, the items being placed in an upright position. The conveyor 1 terminates before the transfer zone, which can be part of the same table plane A on which the conveyor 1 is running, and the continuous stack P is pushed on the table plane forward into the transfer zone by the effect of the conveyor 1. The apparatus comprises separator elements E for separating stack portions OP from the continuous stack P and pusher elements T for moving the stack portions aside for further handling, such as packaging.

The separator elements E and the pusher elements T are placed substantially on the transfer zone on one side of the travel path of the stack, and such elements are prior known for example from Finnish Patent No. 87438 and U.S. Pat. No. 3,562,775.

Between the pusher elements T and a device for further handling, placed on the opposite side of the travel path of the stack in relation to the pusher elements, transfer elements S are provided for gripping the stack portion OP and moving it further. The transfer elements S consist of a gripper 2 and a frame element 6, to which the gripper is coupled. The function of the gripper is to compress the stack portion OP and to hold the stack during the transfer stage.

Figure 2:
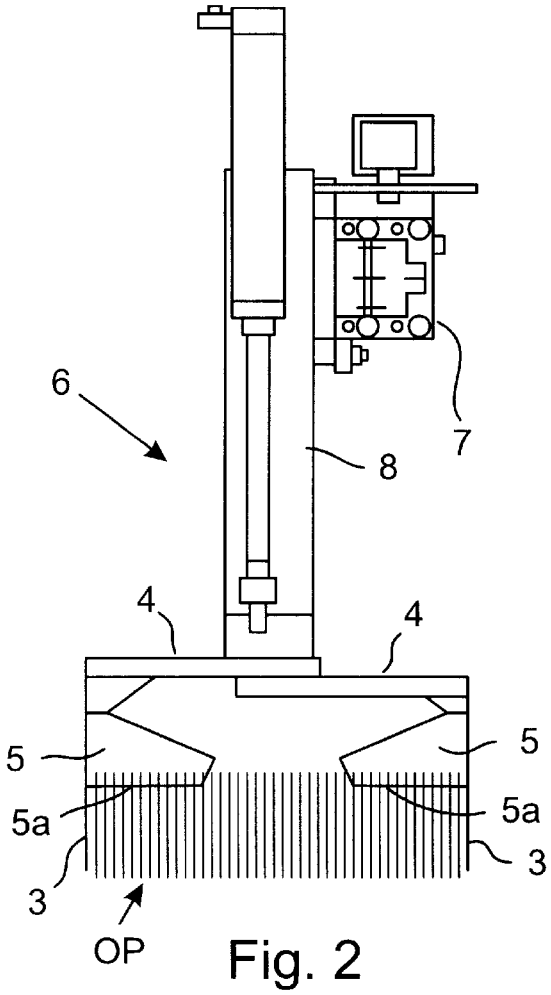
FIG. 2 shows the transfer arrangement of the apparatus seen from behind.
Figure 3:
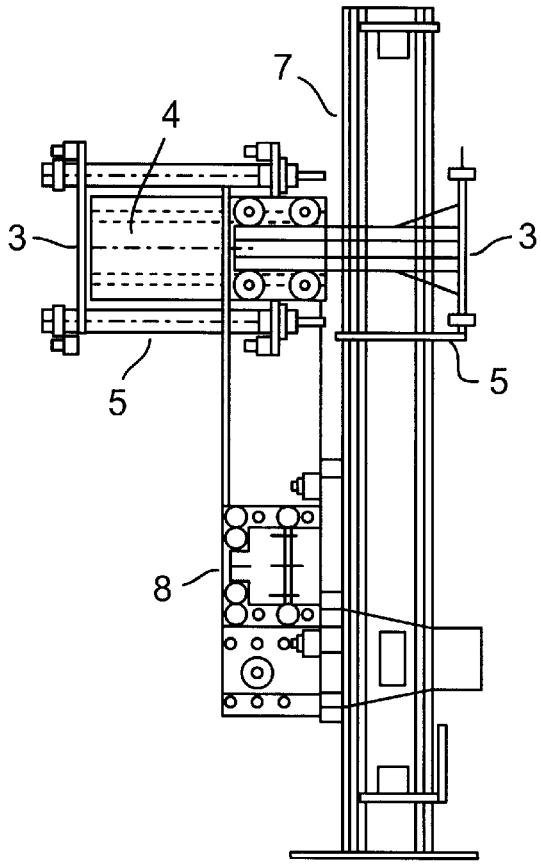
FIG. 3 shows the transfer arrangement of the apparatus seen from above.

The gripper 2 consists of two upright, preferably rectangular plate-like jaws 3, between which the stack portion OP is inserted, two support arms 4 for connecting the jaws 3 with the frame element 6, and at least one fin 5 fixed at either jaw 3. In an advantageous embodiment, as shown in FIGS. 2 and 3, at least one fin 5 is provided in the upper part of the edge of each jaw 3 on the side of the conveyor 1, the fins substantially facing each other in a perpendicular direction. The lower edge 5*a* of the fin 5 is straight, and the fin is coupled to the jaw 3 in a way that its lower edge 5*a* is horizontal, thus forming an angle of 90° to the jaw 3. The height of the jaw 3 part left below the lower edge 5*a* of the fin is slightly smaller than the height of the stack portion being handled at the time, in the same way as it is also advantageous that the length of the jaw 3 is smaller than the length of the stack portion. It is obvious that the shape and structure of the jaws 3 can be also different from that described above, for example rod-like or frame-like. Also the shape of the fin can be different from that described above. The most important fact is that the inner surfaces of the jaws 3 are parallel, that they can press the stack portion OP between them and that their outer surfaces are parallel with the vertical side walls of the package box and fit between them.

Figure 1:
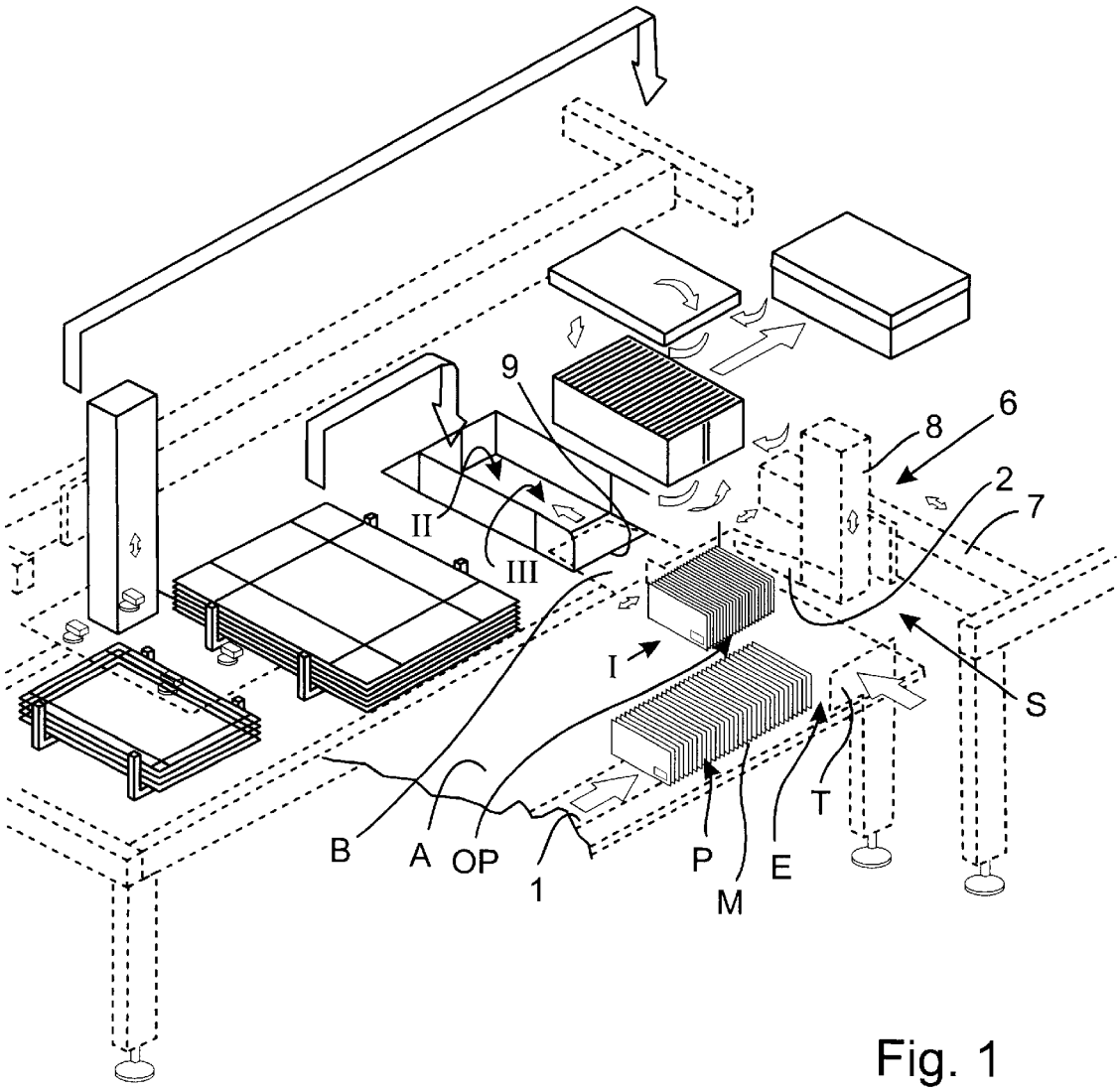
FIG. 1 shows the apparatus in a perspective view.

The frame element 6 consists, for example, as shown in the figures, of a horizontal body 7 and a vertical body 8 coupled to the same, the gripper 2 being coupled to the vertical body 8, as well as of actuators, known as such, effective between them. The horizontal frame 7, the vertical frame 8 and the gripper 2 are arranged to be movable by the drive means in a way that the gripper 2 can move up and down and move in the horizontal plane at least from a position 1, where a stack portion is pushed into the gripper 2, to a position II, where the gripper 2 releases the stack portion into a package box. The frame element 6 can be mounted to the rest of the packaging apparatus by means of a separate support construction, as shown in FIG. 1, or it can be fixed to it in a stationary manner.

The transfer means S also comprises at least one actuator for changing the distance between the jaws 3 of the gripper 2. In the construction according to this embodiment, one of the jaws 3 is arranged to move in the horizontal plane towards and from the other jaw, whereas the other remains stable in relation to the frame element 6. It is obvious that the distance between the jaws 3 can also be changed by arranging both jaws movable e.g. in a concentric manner in relation to the vertical center line between them. Consequently, for example the starting position of the jaws 3 can be always adjusted according to the width of the stack portion OP to be inserted between them, which is determined by the dimensions of the package box to be used at a time. Furthermore, when both of the jaws are movable, the point of transfer into the box can be finely adjusted by changing the extreme positions of the jaws 3.

After the separator elements E have separated the stack portion OP from the continuous stack P by using a marker envelope M sticking out from the stack, the pusher elements T push the stack portion in between the jaws 3 of the gripper 2. At this stage, the gripper 2 is in the position I, the jaws 3 are at a sufficient distance from each other and the gripper 2 is slightly above its lowest position, so that the stack portion can be pushed into the gripper from below the fins 5 in between the jaws 3. Next, the gripper 2 falls slightly downwards until the lower edges 5*a* of the fins 5 descend to a position lower than the level of the upper surface of the stack portion and are placed to support the stack from behind, after which the jaws 3 of the gripper 2 compress the stack portion sufficiently so that the stack remains between the jaws 3 when the gripper moves and that the gripper can, without trouble, to be inserted in the package box between the upright side walls. Due to the support by the fin/fins 5, the stack portion does not need to be compressed as tightly as would otherwise be necessary for securing the transfer. After this, the gripper 2 is moved along the surface of the table plane A, the table plane supporting the stack from below, in the vertical plane towards the package box until the stack finally reaches position II inside the box, where the jaws 3 release the stack portion from their compression so that the stack remains in the package box. The gripper 2 is then detached from the stack portion and elevated from the box. The gripper 2 returns to the position I, whereafter the movements of the gripper and the jaws described above are repeated. Upon movement of the gripper between the positions I and II, the pusher elements T return to their starting position, from which they move a new stack portion to the gripper.

Alternatively, a different kind of support can be arranged in the transfer elements 2 for supporting the stack portion OP from behind. This can be for example a plate which is fixed to the structure moving along the horizontal body and which is descendable after pushing the stack portion into the gripper, whereby the gripper can be in its lowermost position before pushing the stack portion. However, such a movable support will require a separate actuator.

The transfer elements S are arranged to operate in such a fashion that the gripper 2 can move between more than two stations. For example in the embodiment of the figure, where two stack portions are placed in the package box in succession, the gripper moves first from a position I to a position II and back and after this from the position I to a position III and back. This is achieved by providing the actuator guiding the movement of the vertical body 8 along the horizontal body 7 with alternately differing movement lengths.

In the package construction according to the invention, the package box is, at the filling stage, open on the top side and on the side next to the gripper. The package boxes are supplied as blanks from cassettes and assembled at the filling station and transferred from there for further handling by known means. After the package box is completed at the filling station, an auxiliary plane B hinged to the table plane A is sunk above a horizontal end flap 9 included in the open end of the package box and to be lifted up later, and the gripper 2 moves the stack portion along the auxiliary plane B into the package box.

When the package box has been filled up and the gripper 2 moves towards the position I, the auxiliary plane B is lifted up so that the full box can advance to be finally assembled and closed. For this purpose, the apparatus comprises devices for forming covers from blanks provided in a cassette and for pressing the finished covers on top of the boxes. A new box, ready to be filled in, is simultaneously moved to the filling station, and the above-described stages are repeated.

The blank for the package box can be handled by moving it along a straight path parallel with the conveyor 1 of the stack P. Thus the transfer means presented in Finnish Patent No. 87438 will not be needed for moving the box with its open side in front towards the guide elements of the stack portion and for removing it in the opposite direction after filling.

The above description deals with placing packages into a box which is open on the top side, has an open front side, and on top of which a separate cover is placed for closing the package. The invention can also be applied in other cases where the stack, supported by a carrying surface, is pushed by means of the gripper onto one side of the box.

Figure 4:
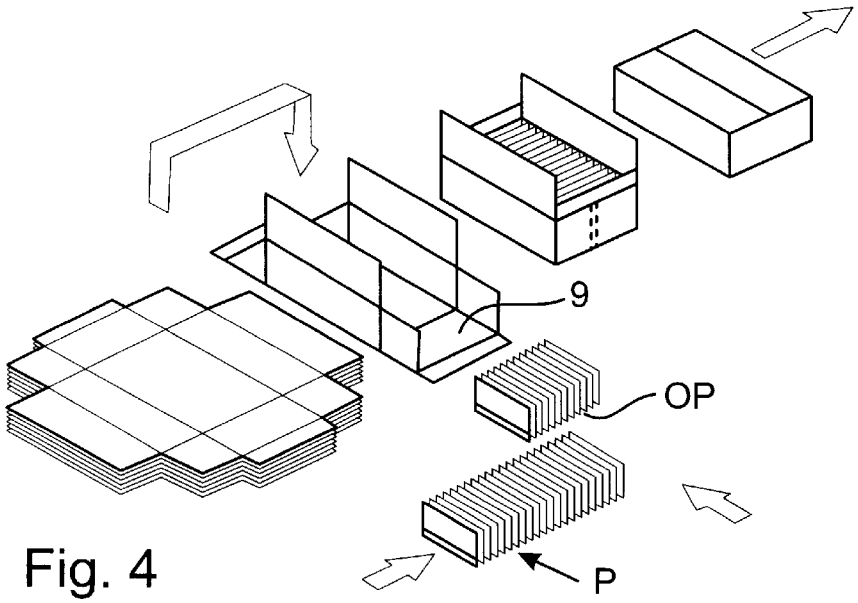
FIG. 4 shows another package type to be used in the apparatus.

FIG. 4 shows a package box of a different kind, applying the principle mentioned above. This box is formed entirely of the same blank, whereby edge flaps forming the cover are provided as extensions of vertical side walls next to the front wall, i.e. the end flap 9, lowered down at the packaging station. The assembly of the stack portion OP itself is conducted according to the same principle as above, whereafter the front and back walls are lifted up and the edge flaps are folded as a cover on top of the box open on the top side.

Figure 5:
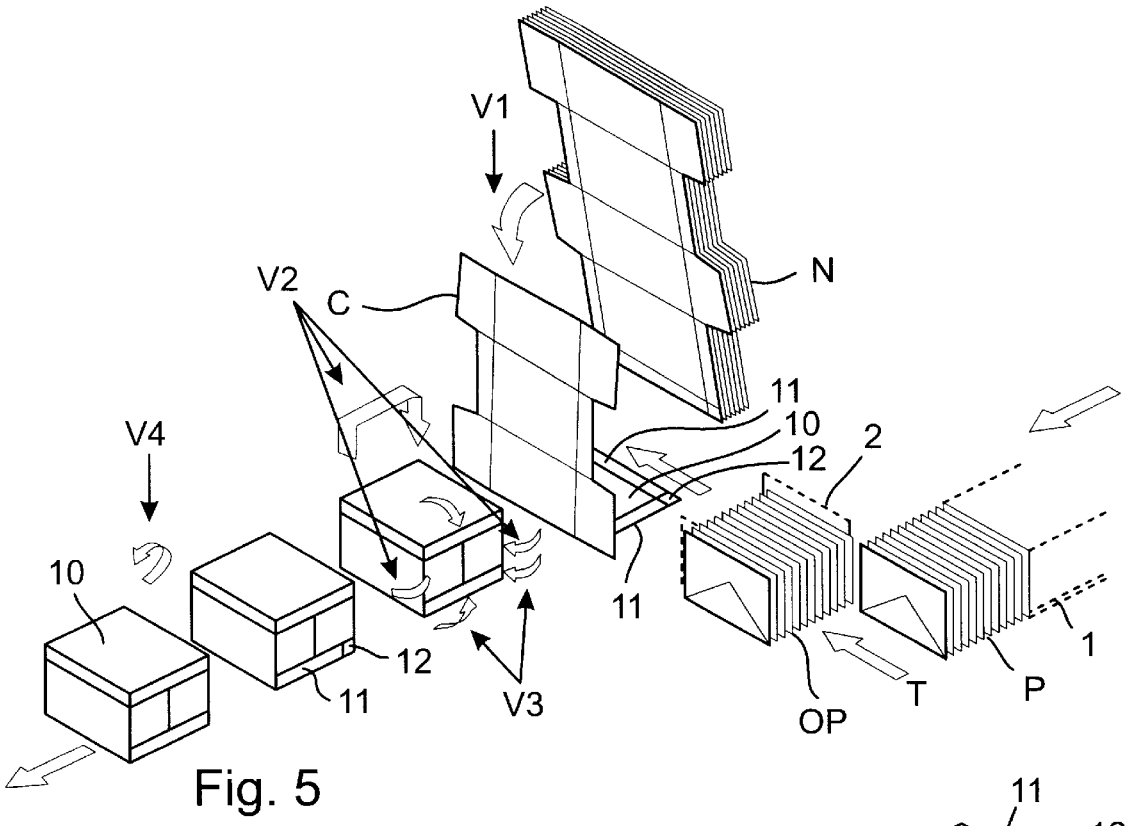
FIG. 5 shows a third package type to be used and steps of the packaging method.
Figure 6:
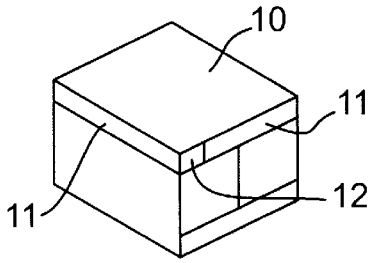
FIG. 6 shows the finished box of FIG. 5 in a form in which it is conveyed further.
Figure 7:
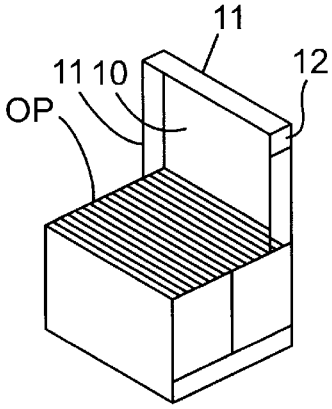
FIG. 7 shows the box ready packed with its contents but with its cover open.

FIGS. 5 to 7 show a third alternative where packaging takes place onto the future cover instead of the bottom of the box. In the following, a new use of this prior known box type will be described in more detail.

The box is assembled, like the boxes in FIGS. 1 and 4, from a blank which is ready cut and provided with scored folding lines. As distinct from the first-mentioned types, this box comprises a cover part 10 which forms the complete cover and is part of the blank, attached at one edge to the main box part.

For assembling such a box provided with the so-called hinged cover, previously a separate machine has been used, whereby, using ready blanks, the box is folded along scoring lines made in the blank to the shape of the box, and the attachment flaps and the edge flaps of the cover are glued or fixed in another way to keep the box together. The finished box is then moved into a place where the products to be packaged are placed in the box, after which the box can be closed. The packaging method described above also requires a great amount of manual work.

In the packaging apparatus according to the invention, the packaging process is considerably simplified by eliminating manual work stages as well as combining necessary work stages and by reducing the requirement of space.

The box itself is assembled of ready blanks by means of a box assembling device directly around the contents of the box, i.e. to surround the finished stack portions OP consisting of the product to be packaged and complying to the inner dimensions of the box. The side of the box blank, onto which the stack portion is pushed, is the cover part 10 forming the cover of the box to be assembled. Next, the rest of the box is assembled on the contents by folding the box blank along the scoring lines and by possibly fixing or gluing the flaps. Finally, the edge flaps of the cover of the box are folded and the box is turned into its correct position, i.e. the cover up.

According to FIG. 5, a stack P of paper goods to be packaged is brought by a conveyor 1 and is separated into stack portions OP of suitable size which are moved by a back and forth moving gripper 2 into a box, as described above. Ready box blanks are transferred as a bundle N to the blank magazine of the box assembly device, from where the blanks C are taken one by one for handling, by means of prior known transfer arms.

At the first step V1, the box assembling device folds the package blank C along the scoring lines so that the cover part 10 of the finished package is horizontal and the rest of the blank stands upright, i.e. the blank forms an L-shape seen in the moving direction of the gripper 2. The stack portion OP to be packaged is transferred by means of the gripper 2 on top of the cover part 10 of the blank. In this position, the blank is transferred further away from the package station, whereby a supporting arm may be arranged movable with the transfer means, for keeping the stack portion OP upright on that side which is not supported by the upright blank part. After this, at the second step V2, appropriate operating elements fold the blank C of the package to surround the stack portion OP to be packaged, and fix the side flaps holding the package together by gluing or in another suitable manner in the order shown in FIG. 5. At the third step V3, the edge flaps of the cover part 10 are folded onto the flaps folded as side walls, whereby the box is finished. If, of the flaps of the cover part, only the short connecting flaps 12, located at marked positions of the edge flaps at each end of one edge lid 11 and keeping the cover together, are glued or in another way fixed to the adjacent edge lids 11, the box will be provided with a hinged cover which can be easily opened and closed. At the fourth step V4, the box is turned 180° so that the cover will face upwards.

FIG. 6 shows the box after turning. It is advantageous to turn the box with the packaging device, because the covers will thus be correctly positioned when the boxes are collected into larger consignments e.g. in a pallet loading station.

FIG. 7 shows the box with the cover open. It is also obvious to a person skilled in the art that assembling the box from a blank can take place at the same packaging station from beginning to end, but for better capacity, it is advantageous to transfer the blank C at once for further handling when the stack portion OP has been pushed onto the cover part 10.

It is possible in the box assembling device to apply prior known principles for folding and fixing flaps. The transfer arms can be e.g. arms which are provided with suction pads and are raised from the frame of the box assembling device, grip the closest blank C of the bundle N in the blank magazine and put it down onto the packaging station, simultaneously folding it into L-shape. In this context, reference is made to solutions presented in U.S. Pat. No. 4,614,511 and in the Finnish Patent No. 83189 by the Applicant. The turning of the finished box 180° to the correct position can be conducted by elements rising from the plane of the box conveyor or by a dropping device at the end of the conveyor.

It is obvious for a person skilled in the art that all the packaging apparatuses according to the invention described above are well suited for packaging a variety of paper goods provided in a stack. In addition to envelopes, such items include different paper sheets, note pads or carton products, such as cards.

In all the above-described alternatives, it is possible to use a prior known mechanism for pusher elements T and separator elements E, for example a solution known from the Applicants previous International Application No. PCT/FI95/00032, Publication No. WO 95/20523.

It is also possible to modify the apparatus shown in the drawings so that the location of the separated stack portion where the gripper starts its transfer movement is already in the travel path of the continuous stack. The separator elements must in this case be able to create a clear gap between the stack portion at the end of the continuous stack and the rest of the stack to enable the penetration of the gripper jaw. In this case the gripper fulfils also the function of the pusher elements.

The movements of the different elements in the apparatus and their synchronization can be arranged using actuators and control means known from automatics. For example, the actuators providing the movement of different parts can be accomplished by using pneumatic cylinders.

Although described above with reference made to packaging enve lopes, the invention can be applied to packaging any paper goods or article goods forming a stack which is characterized by relatively thin flat objects which can be divided into smaller stack portions and be transferred between gripper jaws.

What is claimed is:

1. An apparatus for packaging goods from a continuous stack, said apparatus comprising:

a base;

a conveyor arranged on said base to move said continuous stack in a conveying direction along a travel path having two sides;

separator means for separating a stack portion of a predetermined size from said continuous stack;

a gripper having two jaws placed in a receiving position on one side of the travel path;

pusher means placed on an opposite side of the travel path for pushing said stack portion aside from said continuous stack horizontally in a direction perpendicular to said conveying direction to said receiving position between the jaws of said gripper, said jaws being adapted to compress and hold said stack portion, and said gripper being arranged to transfer said stack portion along a second direction in a horizontal, linear transfer movement from said receiving position to at least one packaging position in a box or on a packaging blank, said horizontal, linear transfer movement of said gripper being parallel to said base so that said base supports said stack portion during said transfer.

2. An apparatus according to claim 1 wherein said gripper is arranged to transfer said stack portion along said second direction substantially perpendicular to said conveying direction.

3. An apparatus according to claim 1 wherein said gripper is arranged to move both in a vertical and in a horizontal direction, which are substantially perpendicular to the travel path of the stack.

4. An apparatus according to claim 3, wherein said gripper is arranged to be transferred upwards in the packaging position at the location of the box and downwards in the location of the separated stack portion.

5. An apparatus according to claim 1, wherein the jaws of the gripper are arranged to move in a direct line towards and away from each other by a movement of either one or both of the jaws in relation to a frame of the gripper.

6. An apparatus according to claim 1, wherein said gripper further comprises a support placed against the rear surface of the stack portion at least during the transfer movement.

7. An apparatus according to claim 5, wherein the support is a fin coupled to the gripper and arranged to support the rear surface of the stack portion.

8. An apparatus according to claim 7, wherein the fin is fixed to at least one jaw of the gripper.

9. An apparatus according to claim 7 wherein before the lowest position of the gripper is in its vertical movement, an intermediate position is arranged where the pusher means are arranged to push the stack portion to below the fin.

10. An apparatus according to claim 1, wherein the gripper is arranged to move the stack portion onto one side of the box blank, wherein the apparatus comprises further a box assembling device arranged to fold the other-parts of the blank to surround the stack portion so that the stack portion is left entirely inside the box.

11. An apparatus according to claim 10, wherein the box assembling device is arranged to fold the blank part forming the cover of the box to first form a bottom, onto which the stack portion is transferred.

12. An apparatus according to claim 11, wherein a device is provided after the box assembling device, arranged to turn the finished box finally into a position where the cover faces upwards.

13. An apparatus according to claim 10, wherein the box assembling device comprises elements for folding the box blank first along one scoring line between the blank parts so that the side, onto which the stack portion is transferred, is horizontal, whereas the rest of the black is perpendicular to it.

* * * * *